US009841148B1

(12) United States Patent
Wang et al.

(10) Patent No.: US 9,841,148 B1
(45) **Date of Patent: *Dec. 12, 2017**

(54) ELECTRICAL CONNECTION STRUCTURE OF LAMP CAP

(71) Applicant: XIAMEN ECO LIGHTING CO. LTD., Xiamen (CN)

(72) Inventors: Qiyuan Wang, Xiamen (CN); Yunnan Lin, Xiamen (CN); Liping Lin, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 15/632,873

(22) Filed: Jun. 26, 2017

Related U.S. Application Data

(63) Continuation of application No. 15/432,009, filed on Feb. 14, 2017, now Pat. No. 9,719,638, which is a continuation of application No. 15/113,837, filed on Jul. 24, 2016, now Pat. No. 9,605,811.

(51) Int. Cl.

| | |
|---|---|
| ***H01K 1/00*** | (2006.01) |
| ***F21K 9/235*** | (2016.01) |
| ***F21V 23/00*** | (2015.01) |
| ***F21K 9/238*** | (2016.01) |
| ***F21V 17/12*** | (2006.01) |
| ***F21V 29/70*** | (2015.01) |
| ***H01R 31/06*** | (2006.01) |
| ***H01R 13/22*** | (2006.01) |
| ***H01R 33/22*** | (2006.01) |

(52) U.S. Cl.
CPC ..... *F21K 9/235* (2016.08); *F21K 9/238* (2016.08); *F21V 17/12* (2013.01); *F21V 23/005* (2013.01); *F21V 29/70* (2015.01); *H01R 13/22* (2013.01); *H01R 31/06* (2013.01); *H01R 33/22* (2013.01)

(58) Field of Classification Search
CPC .... H01R 33/09; H01R 13/26; H01R 13/5216; H01R 13/521
USPC ..... 439/617, 918, 699.2, 276, 936
See application file for complete search history.

(56) References Cited

U.S. PATENT DOCUMENTS 7,025,612 B1 * 4/2006 Keilholz ..... H01R 33/22 429/230
7,284,895 B2 * 10/2007 Goto ..... H01R 13/5205 313/318.09

(Continued)

*Primary Examiner* — Phuong Chi T Nguyen
(74) *Attorney, Agent, or Firm* — Chun-Ming Shih

(57) ABSTRACT

An electrical connection structure (100) of a lamp cap, comprising a substrate (20), a plastic piece (30) and a lamp cap (60), wherein the lamp cap (60) comprises a first electrode (61) and a second electrode (62). The first electrode (61) is insulated from the second electrode (62) and the second electrode (62) is fixed to the first electrode (61). The first electrode (61) is electrically connected to the first connection end (21). The second electrode (62) is of a rod-shaped structure. The second connection end (22) comprises a connection part (222) and a contact part (221). The connection part (222) is electrically connected to the electronic element on the substrate (20), and the contact part (221) is electrically connected to one end of the second electrode (62). The electrical connection structure (100) of a lamp cap has the advantages of simple structure and convenient automation of assembly.

13 Claims, 4 Drawing Sheets

(56) References Cited

U.S. PATENT DOCUMENTS

| | | | | |
|---|---|---|---|---|
| 7,306,488 | B2 * | 12/2007 | Krijne | H01R 33/94<br>439/617 |
| 8,226,440 | B2 * | 7/2012 | Mouchon | H01R 13/6272<br>439/617 |
| 2006/0187682 | A1 * | 8/2006 | Goto | H01R 13/5205<br>362/652 |
| 2010/0311267 | A1 * | 12/2010 | Mouchon | H01R 13/6272<br>439/375 |

* cited by examiner

ELECTRICAL CONNECTION STRUCTURE OF LAMP CAP

CROSS REFERENCE

The present application is a continuation-application of U.S. patent application Ser. No. 15/432,009 filed on Feb. 14, 2017 which in turn is a continuation-application of U.S. patent application Ser. No. 15/113,837 filed on Jul. 24, 2016, now U.S. Pat. No. 9,605,811.

FIELD OF INVENTION

The present invention relates to LED illumination field and more particularly is a type of an electrical structure of a lamp cap.

BACKGROUND

In recent years, LED chips as illumination source used in indoor illumination field are developed rapidly. People continuously discover LED lamps that are easily manufactured and have stability. A traditional LED lamp structure mainly includes five parts of a bulb head, a driver, a radiator, a LED aluminum substrate and a bulb housing, where the LED aluminum substrate and the driver are of a separate style, and the driver and the LED light source are connected via melding. For example, the China invention patent, issued and published on Aug. 15, 2013 with patent No. 201320502252.5, disclosed a type of LED lamp structure piece. The LED lamp structure piece includes a lamp housing, a radiator, a LED light source plate, and a lamp cap, where the radiator includes a radiator base, cooling fin, and a hollow tube, the hollow tube is located below the radiator base and connected to the radiator base, and the hollow tube has a inside space for containing LED driver source.

Because the driver source is contained in the sleeve tube in the center of the radiator, when the driver source is connected with the LED source plate, electrical wires need to be go through the center of the radiator and fixed to the LED aluminum substrate via melding, which is complicated on assembling and causes high manufacturing cost.

SUMMARY OF INVENTION

Technical Problem

In view of such, there is a need to provide a bulb head electrical connection structure that has simple structure for automatic assembling.

Solution for Problem

The technical solution of the present invention is: a lamp cap electrical connection structure including a substrate, a plastic piece, and a lamp cap, in which the lamp cap includes a first electrode and a second electrode, the first electrode is insulated from the second electrode, the second electrode is fixed relative to the first electrode, the plastic piece is disposed above the first electrode, the substrate is fixed on the plastic piece, the substrate has electronic components and has a first connection end and a second connection end electrically connecting to the electronic components, the first electrode and the first connection end are electrically connected, the second electrode is a lever structure, the second connection end includes a connection part and a contact part, the connection part is electrically connected to the electronic components on the substrate, and the contact part is electrically connected to one end of the second electrode.

Compared with conventional art, the lamp cap electrical connection structure has electronic components and the LED light source disposed on the substrate at the same time and has the first connection end and the second connection end disposed on the substrate and electrically connected to the electronic components for the first electrode of the lamp cap being electrically connected to the first connection end, and for the second electrode of the lamp cap being electrically connected to the second connection end, so as to remove the need for disposing electrical wires for performing electrical connection and to perform electrical connection between the driver circuit and the lamp cap while fixing the substrate, and such design simplifies the structure, performs easy installation, has simple structures and is easy to be assembled automatically.

DETAILED DESCRIPTION

Figure 1:
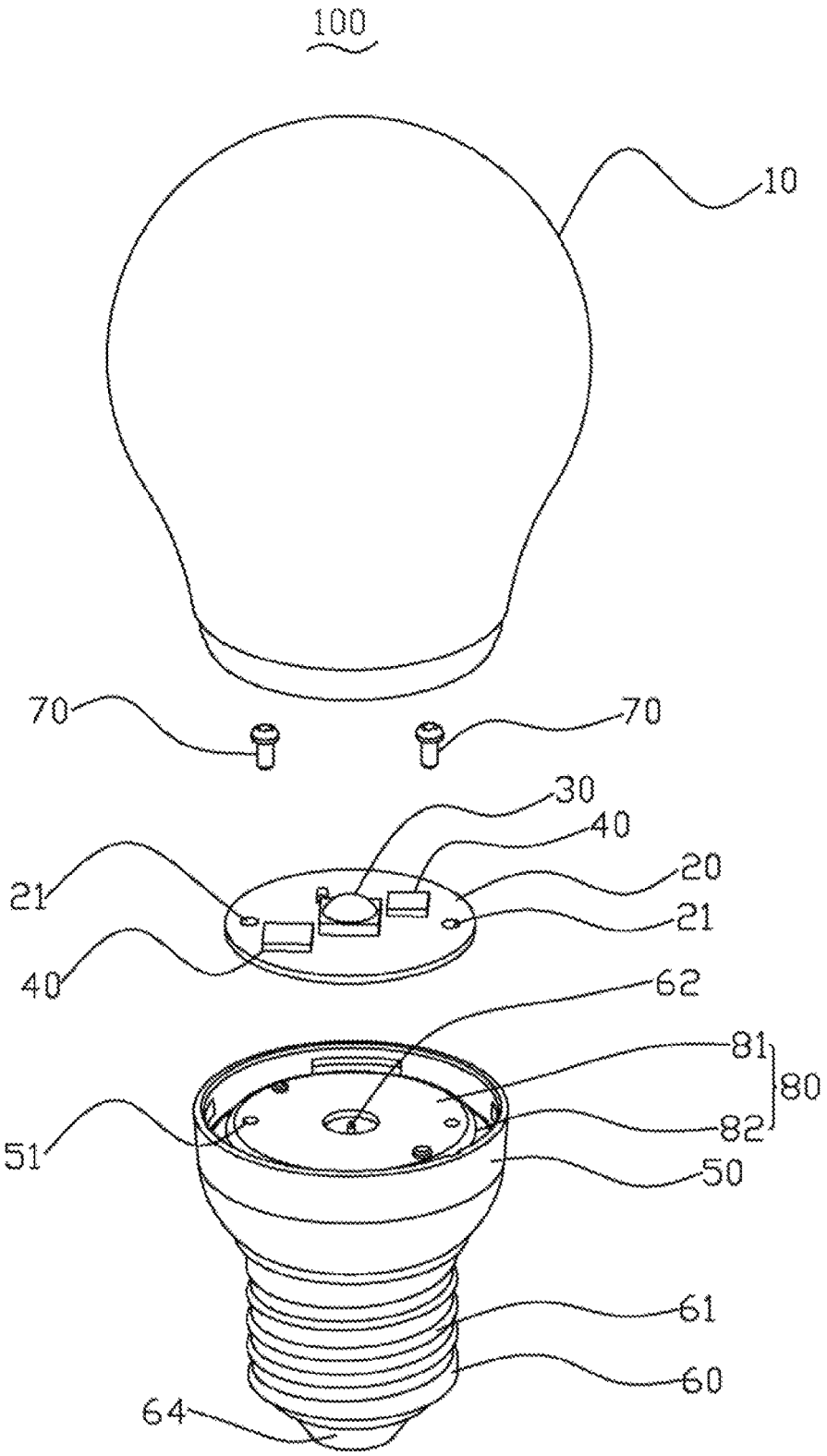
FIG. 1 is an exploded perspective diagram of a lamp cap electrical connection structure in a first embodiment of the present invention.
Figure 2:
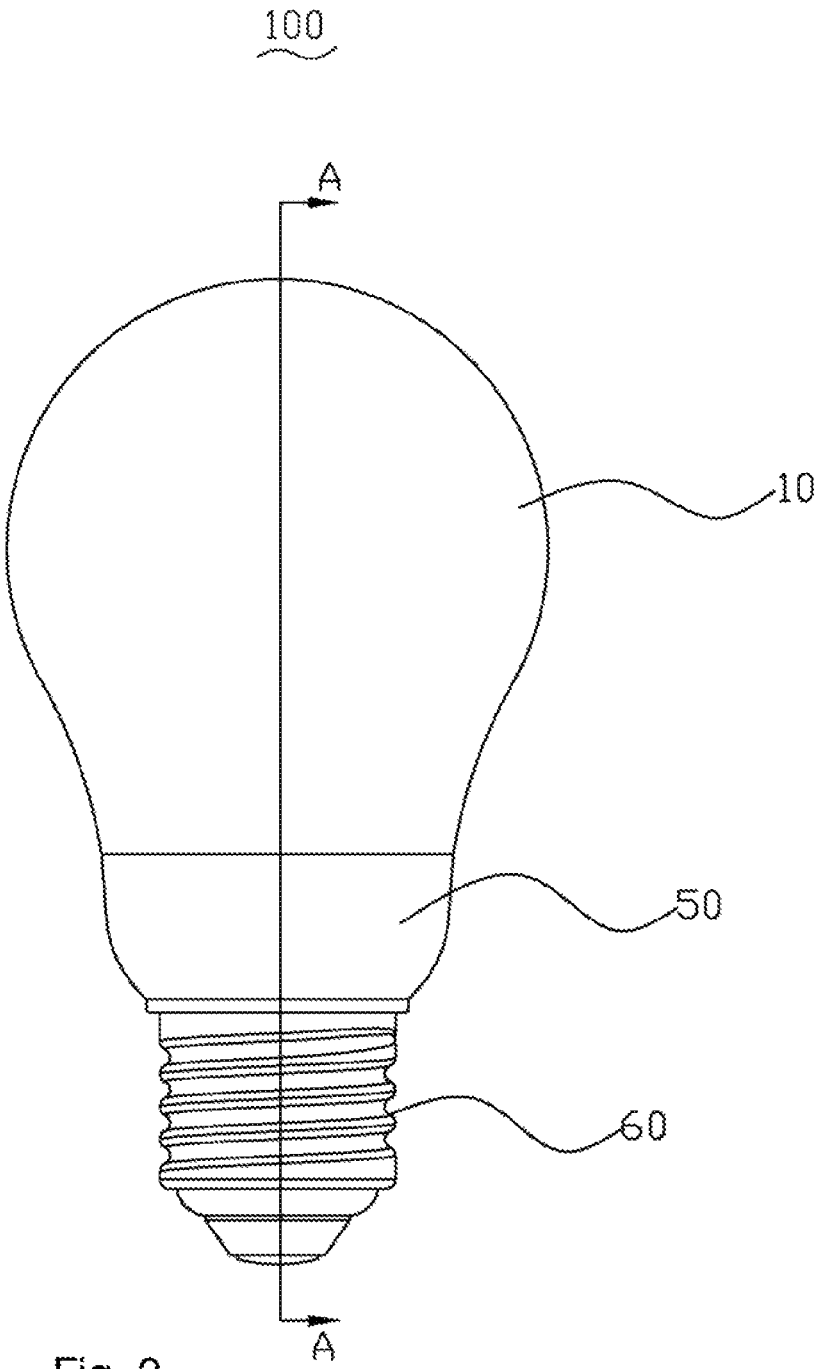
FIG. 2 is a main view diagram of the lamp cap electrical connection structure of FIG. 1.

FIG. 1 is an exploded perspective diagram of a new utility lamp cap electrical connection structure 100, where the lamp cap electrical connection structure 100 includes a substrate 20, a plastic piece 50, a lamp cap 60, and a radiator 80. The lamp cap 60 includes a first electrode 61 and a second electrode 62, the first electrode 61 is insulated from the second electrode 62, and the second electrode 62 is fixed relative to the first electrode 61. The lamp cap 60 is a regular screw lamp cap, and the first electrode 61 is the lamp cap housing. The plastic piece 50 is disposed above the first electrode 61, and the substrate 20 is fixed on the plastic piece 50. The plastic piece 50 is a circular housing structure with openings on both its top and bottom. The substrate 20 has LED light source 30 disposed on its front side, and the LED light source is disposed in the middle of the substrate. The substrate 20 is also integrated with a driver IC chip 40, and also, other electronic components may be disposed and a circuit board may be used for connecting the electronic components. The radiator 80 includes a top plate 81 and a side wall 82 with integral forming, the substrate 20 is fixed on the top plate 81, the side wall 82 is disposed inside the plastic piece 50 and the plastic piece 50 insulates the side wall 82 from outside so that the lamp cap electrical structure 100 is complied with safety standard requirement.

Figure 3:
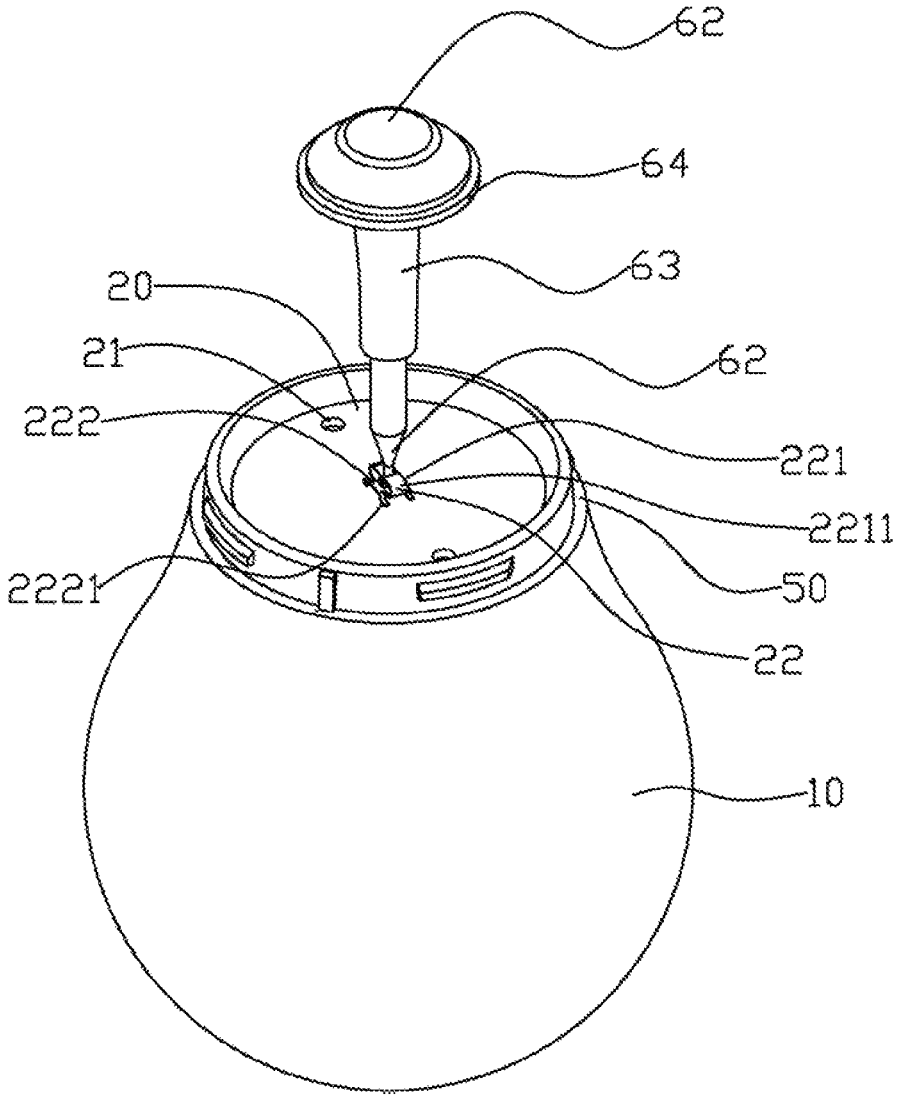
FIG. 3 is a perspective diagram of the lamp cap electrical connection structure of FIG. 1 by removing a plastic piece and a radiator along another angle.

Please refer to FIG. 3, in which the substrate 20 is an aluminum substrate, the substrate 20 has a first connection end 21 and a second connection end 22, the first electrode 61 and the first connection end are electrically connected, the second electrode 62 is a lever structure, the second connection end 22 includes a connection part 222 and a contact part 221, the connection part 222 is electrically connected to the electronic components on the substrate 20, and the contact part 221 is electrically connected to one end of the second electrode 62.

The first electrode 61 may further include an insulation sleeve 64, the insulation sleeve 64 is fixed at the bottom of the first electrode 61, the insulation sleeve 64 has a containing hole (not shown) in its middle part, and the second electrode 62 is disposed in the containing hole. A supporting sleeve 63 is disposed around the containing hole in the middle part of the insulation sleeve 64, the inner wall of the supporting sleeve 63 corresponds to the second electrode 62, the outer wall of the second electrode 62 has a barb (not shown), and the barb is hooked to the inner wall of the supporting sleeve 63. The second connection end 22 is disposed at the back side of the substrate 20, the contact part 221 includes a pair of elastic strips 2211 opposing to each other, and one end of the second electrode 62 is plugged between the two elastic strips 2211 to perform electrical connection. The connection part 222 is a sheet structure, the connection part 222 and the contact part 221 are made with integral forming, the connection part 222 has a connection pin 2221, and the connection pin 2221 is fixed at the back side of the substrate 20.

Figure 4:
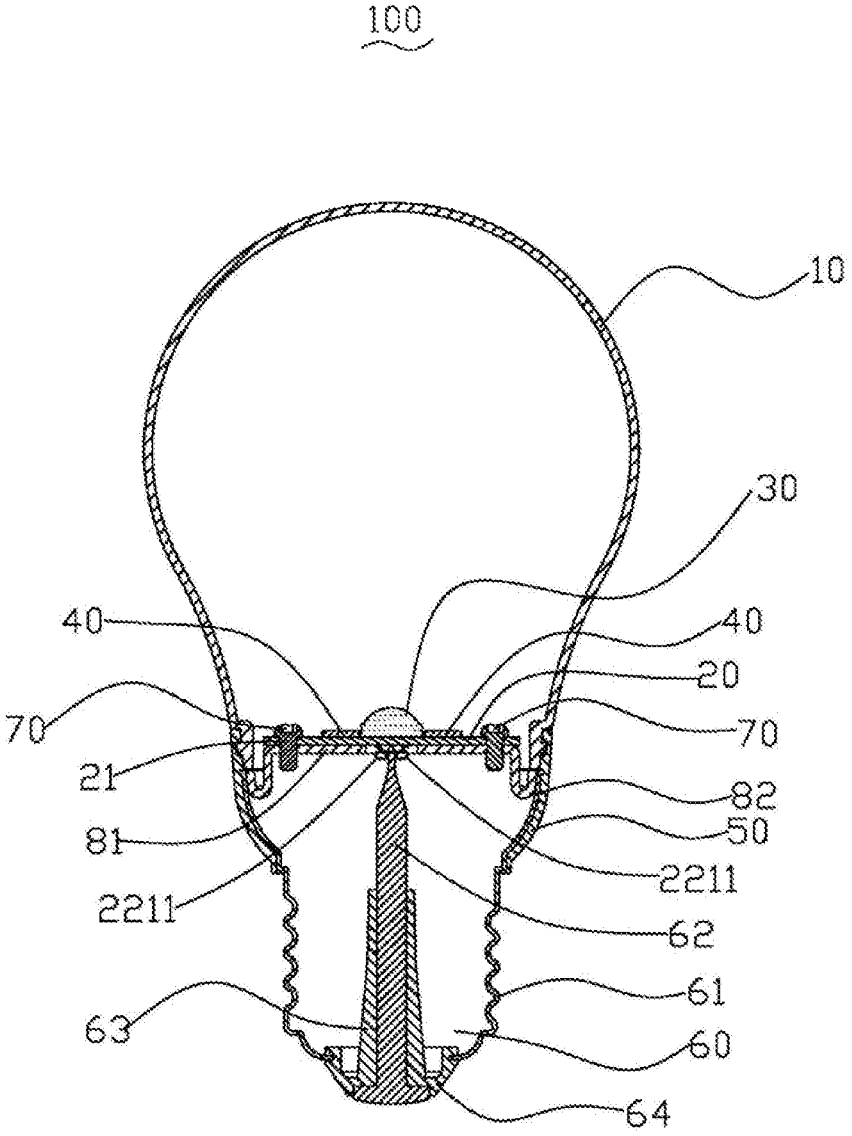
FIG. 4 is a sectional view along A-A line in FIG. 2.

Please refer to FIG. 4, in which the radiator 80 is made of conductive material, the side wall 82 of the radiator 80 is electrically connected to the first electrode 61, the first connection end 21 is disposed at the back side of the substrate 20, the substrate 20 is fixed at the top side of the top plate via a screw 70, and the first connection end 21 is electrically connected to the top plate 81 of the radiator 80.

During operation, the first connection end 21 of the substrate 20 is electrically connected to the top plate 81 of the radiator 80, and the first connection end 21 is able to electrically connect to the first electrode 61 because the side wall of the radiator 80 is electrically connected to the first electrode 61. The second connection end 22 disposed on the back side of the substrate 20 has two elastic strips 2211 disposed at its contact part 221 so that one end of the second electrode 62 with a lever structure is plugged between the two elastic strips 2211 so that the second connection end 22 is electrically connected to the second electrode 62. With such, the first connection end 21 and the second connection end 22 may supply electricity to the electronic components on the substrate 20 like LED light source 30 or the driver IC chip 40.

In summary, the lamp cap electrical connection structure 100 has both a driver IC chip 40 and LED light source 30 on its substrate 20 at the same time, and has the first connection end 21 and the second connection end 22 disposed on the substrate 20 and electrically connected to the electronic components on the substrate 20, so that the lamp cap has the first electrode 61 electrically connected to the first connection end 21 and the second electrode 62 electrically connected to the second connection end 22 to remove the need of disposing electrical wires for performing electrical connection and to perform electrical connection between the driver circuit and the lamp cap while fixing the substrate for simplifying structure and for having advantages of simple structure. In addition, the second connection end 22 is disposed at the back side of the substrate 20, not affecting the placement of the LED light source 30 on the front side of the substrate 20 so as to preserve larger space for light device design. The lamp cap 60 is not limited to screw head lamp, and may be other type of lamp cap like a socket lamp cap. It is only needed to change the second electrode 62 as a lever structure.

The invention claimed is:

1. A lamp cap electrical connection structure, comprising:
a substrate;
a plastic piece;
a driver circuit;
a radiator comprising a top plate and a side wall, the substrate being fixed on the top plate, and the side wall is disposed in the plastic piece; and
a lamp cap, wherein the lamp cap comprises a first electrode and a second electrode, the first electrode is insulated from the second electrode, the first electrode is fixed relative to the second electrode, the substrate is disposed with an electronic component and is disposed with a first connection end and a second connection end electrically connected to the electronic component, the second connection end is disposed on the back side of the substrate so that the second electrode is electrically connected to the second electrode;
wherein the second connection end has two elastic strips, wherein the two strips of the second connection end are disposed at the contact part of the second connection end, wherein the substrate comprises aluminum material;
wherein the second connection end is disposed at the back side of the substrate, the contact part comprises a pair of elastic strips opposing to each other, and one end of the second electrode is plugged between the two elastic strips to perform electrical connection.

2. The lamp cap electrical connection structure of claim 1, wherein the second connection end is at the middle of the back side of the substrate.

3. The lamp cap electrical connection structure of claim 1, wherein a LED light source is disposed on the substrate.

4. The lamp cap electrical connection structure of claim 1, wherein a LED light source is disposed at the middle of the substrate.

5. The lamp cap electrical connection structure of claim 1, wherein the second connection end has a pluggable component for electrically connecting to the second electrode.

6. The lamp cap electrical connection structure of claim 1, further comprising a LED light source disposed at the front side of the substrate.

7. The lamp cap electrical connection structure of claim 1, wherein the first electrode is a lamp head housing further comprising an insulation sleeve, the insulation sleeve being fixed at the bottom of the first electrode, the middle of the insulation sleeve having a containing hole, and the second electrode being disposed in the containing hole.

8. The lamp cap electrical connection structure of claim 7, wherein the middle of the insulation sleeve has a supporting sleeve surrounding the containing hole, the inner wall of the support sleeve corresponds to the second electrode, a barb is disposed at outer wall of the second electrode, and the barb is hooked to the inner wall of the supporting sleeve.

9. An LED lamp apparatus, comprising:
a LED light source;
a substrate for holding the LED light source;
a plastic piece;
a first electrode;
a driver circuit;
a radiator comprising a top plate and a side wall, the substrate being fixed on the top plate, and the side wall is disposed in the plastic piece; and
a second electrode, wherein the first electrode is insulated from the second electrode, the first electrode is fixed relative to the second electrode, the substrate is disposed with an electronic component and is disposed with a first connection end and a second connection end electrically connected to the electronic component, the second connection end has a plugging structure for electrically connected to the second electrode, wherein the second connection end comprises two elastic strips, the substrate comprises aluminum;

wherein the second connection end is disposed at the back side of the substrate, the contact part comprises a pair of elastic strips opposing to each other, and one end of the second electrode is plugged between the two elastic strips to perform electrical connection.

10. The LED lamp apparatus of claim 9, wherein the second connection end is at the middle of the back side of the substrate.

11. The LED lamp apparatus of claim 9, wherein the first electrode is a lamp head housing further comprising an insulation sleeve, the insulation sleeve being fixed at the bottom of the first electrode, the middle of the insulation sleeve having a containing hole, and the second electrode being disposed in the containing hole.

12. The LED lamp apparatus of claim 9, wherein the two strips of the second connection end are disposed at the contact part of the second connection end.

13. The LED lamp apparatus of claim 9, wherein a LED light source is disposed at the middle of the substrate.

* * * * *